United States Patent [19]

Rothe

[11] 4,241,746

[45] Dec. 30, 1980

[54] COLLAPSIBLE BUILDING STRUCTURE

[76] Inventor: Bruce Rothe, 2046 Rutledge St., Madison, Wis. 53704

[21] Appl. No.: 35,222

[22] Filed: May 2, 1979

[51] Int. Cl.[3] ..... E04B 1/347

[52] U.S. Cl. ..... 135/4 R; 52/80; 52/222; 52/645; 135/DIG. 8

[58] Field of Search ..... 135/1 R, 3 R, 4 R, 5 R, 135/7.1 R, DIG. 8; 52/80, 81, 82, 222, 645

[56] References Cited

U.S. PATENT DOCUMENTS

| | | | |
|---|---|---|---|
| 563,375 | 7/1896 | Heintz et al. . | |
| 927,738 | 7/1909 | Malaby . | |
| 1,773,847 | 8/1930 | Nickles . | |
| 2,781,766 | 2/1957 | Krieger . | |
| 3,063,521 | 11/1962 | Fuller . | |
| 3,185,164 | 5/1965 | Pinero | 135/4 R |
| 3,496,687 | 2/1970 | Greenberg et al. | 52/80 X |
| 3,710,806 | 1/1973 | Kelly | 135/4 R |
| 3,968,808 | 7/1976 | Zeigler | 135/4 R |
| 3,982,361 | 9/1976 | Deutsch et al. | 52/80 |
| 4,026,313 | 5/1977 | Zeigler | 135/4 R |

*Primary Examiner*—J. Karl Bell

*Attorney, Agent, or Firm*—Isaksen, Lathrop, Esch, Hart & Clark

[57] ABSTRACT

A collapsible building structure is disclosed which includes a pair of stressed membranes which are fixedly held in spaced relation when the structure is in its erected form. Lines of tension are formed in the membrane when the structure is erected which generally define rectilinear grid patterns. A plurality of node members are arranged on each of the two membranes such that each node member is separated by intersecting lines of tension. Paired nodes on each of the membranes are connected by a tensile member. Each of the nodes on one membrane are connected by a compression strut to the nodes on the other membrane which are most closely adjacent to its paired node on the other membrane. The building structure is selectively collapsed and re-erected by selectively tensing or relaxing the tension members. Building structures may also be formed utilizing flexible tension members connecting the node members which replace the stretched membranes.

18 Claims, 9 Drawing Figures

COLLAPSIBLE BUILDING STRUCTURE

BACKGROUND OF THE INVENTION

1. Field of the Invention

The present invention relates to building structural systems in general, and, in particular, to building construction systems utilizing stressed membranes or their equivalent as structural components.

2. Description of the Prior Art

Various collapsible and re-erectable building structures are known which include a fabric or "skin" covering. One example of such a structure is shown in U.S. Pat. No. 3,968,808 which discloses a collapsible self-supporting structure formed of a plurality of rods secured in scissors-like pairs with the pairs of rods being joined to form a geometric self-supporting shape. Another example of such a collapsible structure is shown in U.S. Pat. No. 3,185,164 which shows a reticular structure including a plurality of rods joined by couplings into groups of three which are inter-related to form a generally hexagonal structural system. Another example of such a collapsible structure is shown in U.S. Pat. No. 3,710,806.

Structures which utilize elements in tension to maintain the rigidity of the structure are also known, as exemplified in U.S. Pat. No. 3,063,521.

The prior art is also generally cognizant of the use of collapsible frame structures for supporting tents or other outdoor shelter. Examples of collapsible frames for use in supporting such tents or outdoor structures are shown in U.S. Pat. No. 563,375, No. 927,738, No. 1,773,847, and No. 2,781,766. Such structures have varied widely in their ease of erection and storage, and are of varying structural strengths.

SUMMARY OF THE INVENTION

The structure of the invention is readily adapted to be easily collapsed and re-erected, and includes first and second stressed membranes disposed in spaced relation, or line grids providing similar tensile connections between nodes. In their erected state, each of the membranes have lines of tension formed therein which define corresponding rectilinear grid patterns in each membrane. Node members are attached to each of the membranes and arranged such that each of the nodes on the first membrane is paired with a corresponding one of the nodes on the second membrane.

The node members are arranged on the membranes such that each node member is located at an intersection of lines of tension in the membranes and is separated by intersecting lines of tension in the membranes from adjacent node members lying along the same lines of tension. A tensile member extends in tension between each of the node members on the first membrane and its corresponding paired node on the second membrane. The membranes are separated by a plurality of compression struts extending between the node members on the first membrane and the node members on the second membrane. The compression struts are arranged such that, at each node member on the first membrane, compression struts extend in compression from attachment to the node member on the first membrane to attachment to each of the node members on the second membrane which are most closely adjacent to and substantially equidistant from the node member on the second membrane which is paired with the node member on the first membrane. The compression struts will thus lie substantially along the diagonals of the rectilinear lines of tension which extend between adjacent node members, with compression struts extending between pairs of node members criss-crossing along their lengths.

It is seen that with this construction, compression forces between any four (or more) adjacent nodes are equally balanced by tension forces in the membranes which extend along the lines of tension in the membranes. Compression forces between the membranes exerted by the struts are balanced by tension in the tensile members between paired nodes.

An equivalent structure may be formed by utilizing tension members attached between node members in place of the stretched membranes. Employment of the membranes is preferred, since they provide structural support as well as shielding the interior of the structure.

The structure is adapted to form walls, flat spans, contilevers, vaults, domes, complex multiple curves, and, in modified form, columns and arches. Curvatures in the structure are easily obtained by selecting the distances between node members on one membrane to be less than the distances between corresponding node members on the other membrane.

The structure may be easily collapsed and compacted by releasing the tension on the tensile members. Because the structure is light, and can be readily collapsed and re-erected, it can be readily adapted for use as a portable structure such as a camping tent. However, such a use is only illustrative, since the structure of the invention is also well adapted to more permanent uses, wherein it enjoys several advantages over conventional structures, including more rapid and simple erection and low weight and expense of the materials used in the structure. Such a structure is well adapted to be pre-assembled in a factory environment with minimum on-site construction time and problems.

Other objects, advantages and features of the present invention will become apparent from the following specification when taken in conjunction with the accompanying drawings.

DESCRIPTION OF THE PREFERRED EMBODIMENT

Figure 1:
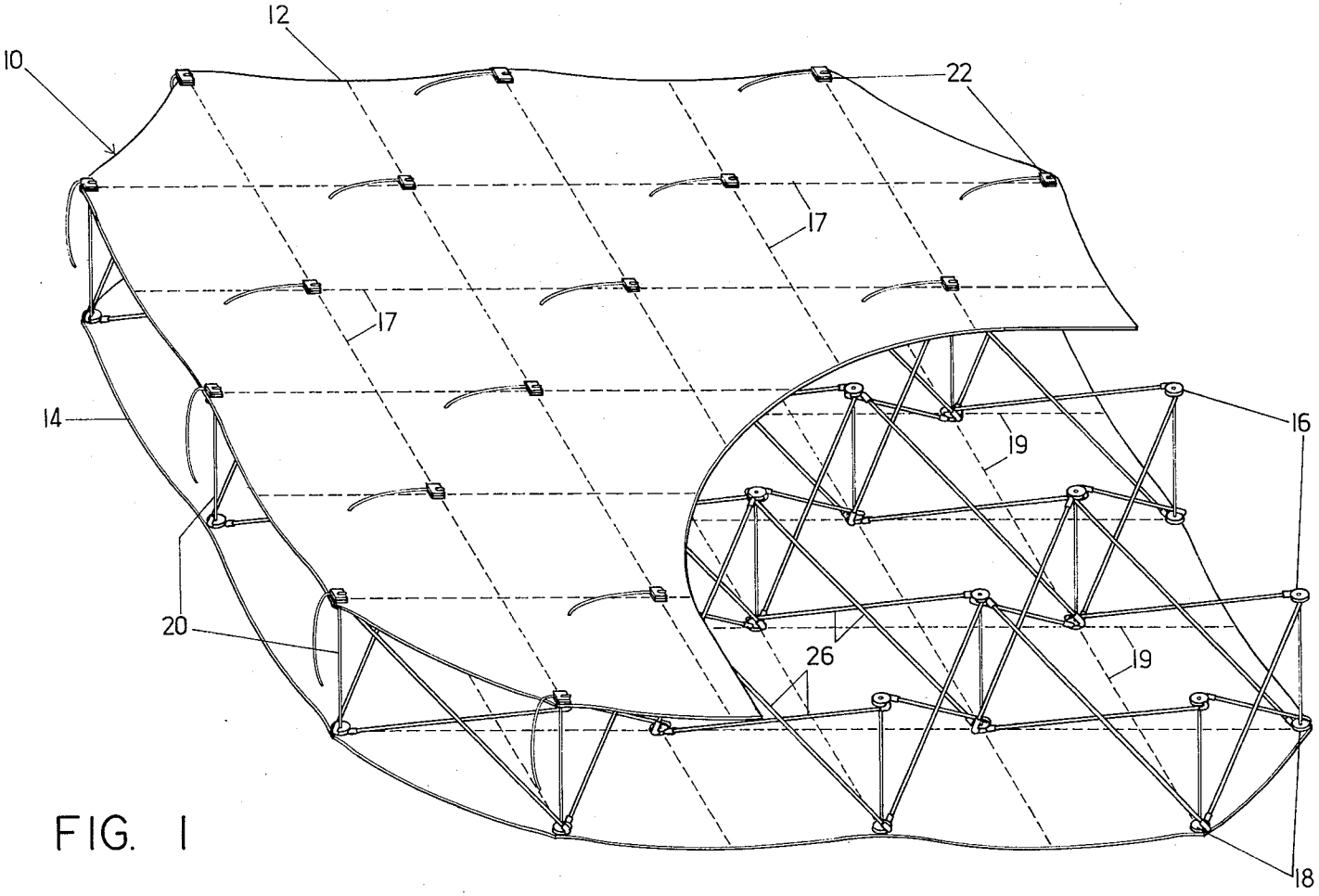
FIG. 1 is an isometric view, partially cut-away, showing a flat collapsible building structure constructed in accordance with the present invention.

Shown in FIG. 1 is a flat collapsible building structure, generally indicated at 10, constructed in accordance with the present invention. The building structure 10 is a general purpose structural component for use in temporary buildings or other structures which can be used alone, or which may be used in combination with other structural members to make a larger building. The building structure 10 is entirely self-supporting, regardless of its physical orientation, and is completely collapsible so that it may be taken down and stored in a compact state and readily re-erected as desired.

The building structure 10 includes two stressed planar members, an upper membrane 12 and a lower membrane 14, which are fixed in spaced relation with regard to each other. As can be seen in FIG. 1, each of the membranes 12 and 14 is formed in a generally planar shape, although other shapes may be suitable for particular applications, as long as the membranes 12 and 14 are generally of similar shapes. The upper and lower membranes are formed of a flexible, relatively inelastic sheet material, such as fabric or strong plastic films. Attached to the upper membrane 12 are a plurality of node members 16. Similarily, a plurality of node members 18 are attached to the lower membrane 14. As can be seen in FIG. 1, the node members 16 and 18 are arranged on the membranes 12 and 14 in similar rectilinear patterns. These patterns are aligned so that each of the node members 16 on the membrane 12 is paired with and positioned directly over a corresponding one of the node members 18 on the membrane 14.

Rectilinear grid patterns dashed lines 17 are shown for purposes of illustration on the first membrane 12, corresponding to the "lines of tension" in the stretched membrane. The lines of tension are the mean geometric location of tension forces in the membrane, and generally the tension forces will be directed along these lines. Similar lines of tension 19 are shown in dashed lines on the second membrane 14, and form a similar rectilinear grid pattern. As noted above, the node members are arranged on the membranes such that each node member is located at an intersection of lines of tension in the membrane, and is separated by intersecting lines of tension from the adjacent node members lying along the same lines of tension.

The dashed lines indicating the lines of tension 17 and 19, and showing the rectilinear grid pattern of these lines, are for illustrative purposes only and will not be visible on the actual structure. However, these lines are representative of the actual tension forces which exist in the stretched membrane and provide a convenient way to properly locate the node members to obtain the desired structure. For example, a rectilinear grid of lines can be marked on the membranes when they are laid out flat. The node members can then be attached to the membranes in the arrangement described above. When the structure is finally erected, the actual lines of tension within the membranes will necessarily be along the marked grid lines.

Each corresponding pair of node members 16 and 18 on the upper membrane 12 and lower membrane 14 are joined together by a vertically extending tensile member 20. One of the tensile members 20 is provided for each pair of the node members 16 and 18 and extends therebetween under significant tensile stress. The tensile members 20 may be formed of any rigid or flexible material having sufficient tensile strength to withstand the forces imposed on the tensile members by the building structure 10, as will be discussed in more detail below. The tensile members are preferably formed of pliantly flexible material of an easily manipulatable character such as rope, cable, or similar material. Each of the tensile members 20 extends through the respective node member 16 on the upper membrane 12 to a clasp 22 mounted to the node members 16. The clasps 22 are formed of two flat members resiliently held together so that the flexible tensile member 20 may be selectively secured to and released from the clasp. If desired for the particular application, clasps or other suitable means for selectively securing the tensile members (not shown) may be mounted on each of the node members 18 on the lower membrane 14, to allow detaching of the tensile members when the structure is collapsed. In the structure 10 shown in FIG. 1, the tensile members are firmly attached to the node members on the lower membrane.

Extending between the node members on the two membranes 12 and 14 are a plurality of compression struts 26 which serve to keep the membranes 12 and 14 in spaced relation with regard to each other. Each of the compression struts 26 is an elongated rigid member of relatively stiff character and formed of a material having significant compressive strength, such as metal, fiberglass, rigid plastic, or wood. As can be seen in FIG. 1, a compression strut 26 extends from each of the node members 16 on the upper membrane 12 to each of those of the node members 18 on the lower membrane 14 which are most closely adjacent to and substantially equidistant from the corresponding node members 18 on the lower membrane 14 which is paired with the one node member 16 on the upper membrane 12. Within the interior of the building structure 10, there are four node members 18 which are most closely adjacent to the paired node member 18 corresponding to each respective node member 16 on the upper membrane 12. These four node members 18 are equally spaced from, and positioned at mutually opposed directions from the paired node member 18 which is matched with the node member 16 on the upper membrane 12. At the edge of the building structure 10, however, there are only two node members 18 which are closest to and equally distant from the paired node 18. Each of the compression struts 26 is firmly attached at each of its ends to a respective one of the node members 16 and 18.

Figure 3:
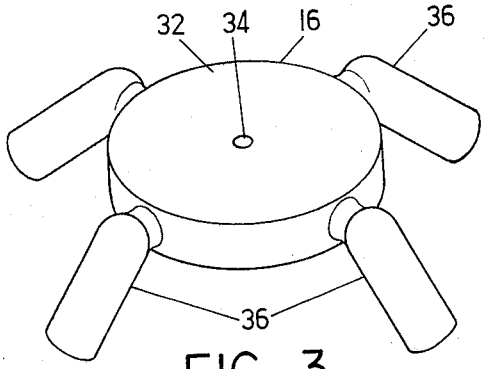
FIG. 3 is an isometric view of a node member for use in either of the embodiments of FIGS. 1 or 2.
Figure 4:
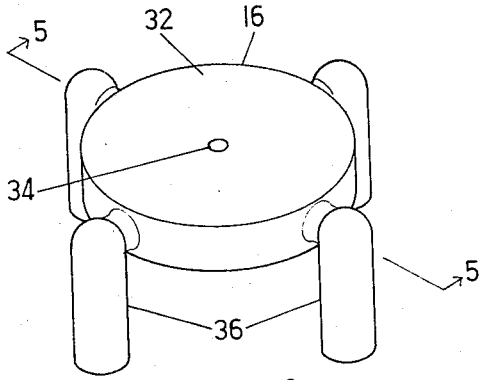
FIG. 4 is an isometric view of the node member of FIG. 3 showing the strut connectors flexed into a vertical position.
Figure 5:
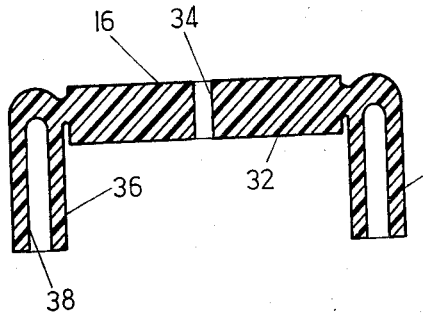
FIG. 5 is a cross-sectional view taken through the node member of FIG. 3.

Shown in FIGS. 3–5 are the details of the construction of a one of the nodes 16, with it being understood that the node members 18 are in all respects identical to the node members 16, with the exception that they may include some alternative provision for securing one end of the tensile member 20 thereto. The node member 16 of the FIGS. 3–5 includes a body member 32 having a hole 34 centrally located therein so that the tensile member 20 may pass therethrough. Extending outwardly from the body member 32 are four strut connectors 36 which are positioned around the periphery of the body member 32 so that adjacent ones of the strut connectors 36 are mutually perpendicular from each other. As can be seen from a comparison of FIG. 3 to FIG. 4, the strut connectors are tiltable within a range of movement relative to the body member 32. As can be seen in the cross-sectional view of FIG. 5, each of the strut connectors 36 has a strut receiving cavity 38 formed therein. As an alternative configuration, solid rods may extend from the node member body and be engaged in the bore of compression struts formed as hollow tubes.

Figure 2:
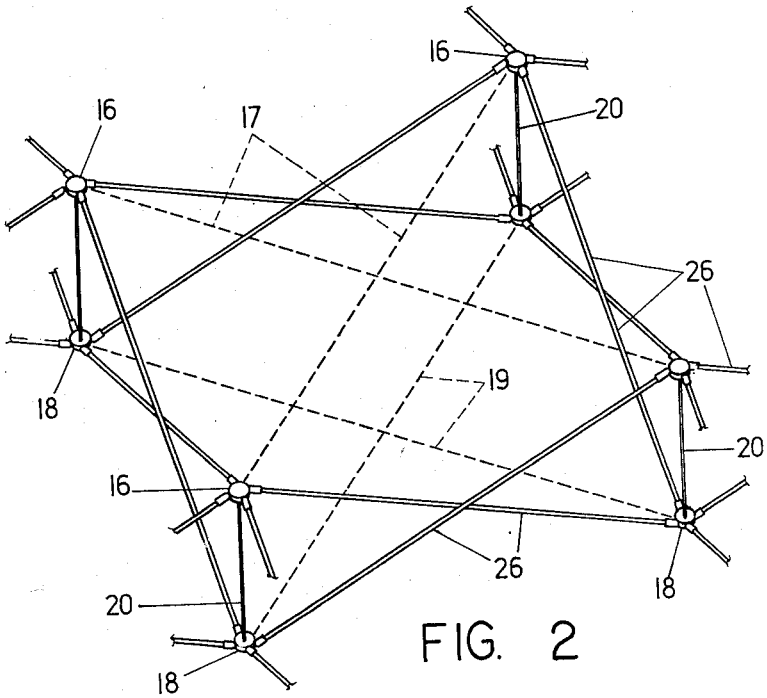
FIG. 2 is an isometric view of a working group usable in a building structure in accordance with the present invention, with the stressed membranes being cut-away.

Shown in FIG. 2 is a working structural unit of a building structure which is illustrative of the structural working of the present invention, even though it differs slightly from the building structure 10 of FIG. 1 as will be discussed below. The upper and lower membranes 12 and 14 are omitted from FIG. 2 for the purposes of clarity, with dashed lines indicating lines of tension. It is to be understood that the membranes 12 and 14 are necessary to the structural integrity of a building structure constructed in accordance with the present invention. As can be seen in FIG. 2, the four node members 16 which would be located on the upper membrane 12 define between them a parallelogram, in this case a square, although it is envisioned that the parallelogram so defined need not necessarily be a square but may be diamond-shaped. The compression struts 26 are placed so that along each side of the two parallelograms on the upper and lower membranes 12 and 14, a compression strut extends from the upper node member 16 at one end of each such side to the node member 18 at the other end of each such side. In other words, for each two of the node members 16 on the membrane 12 which define a side of the parallelogram on the membrane 12, a compression strut 26 extends from each of these two node members 16 to the node member 18 on the membrane 14 which is paired with the other one of the two node members 16. The four node members 16 and 18, together with the respective tensile members 20 and compression struts 26, define a working unit of the building structure 10. This working unit stretches the respective membranes 12 and 14 tightly between the sets of node members 16 and 18 to form a pair of stressed skins. Indicated in FIG. 2 by the dashed lines labeled 17 and 19 are the lines of tension which are formed respectively in the upper membrane 12 and lower membrane 14.

Thus, the stretched nature of the membranes 12 and 14 acts to pull against and compress the struts 26 so as to tend to pull each pair of the node members 16 and 18 away from each other. The tensile members 20 serve to hold each of the pairs of node members 16 and 18 close to each other, so as to resist the collapsing force exerted by the membranes 12 and 14. Thus the forces exerted by the membranes 12 and 14, the compression struts 26, and the tensile members 20, tend to counteract each other in a balanced relation so as to form a self-supporting stable rigid structure. The structure so produced, as for example the building structure 10, is sufficiently rigid so as to bear other loads in addition to that of the structure itself so as to be usable as a structural component of a larger structure or building.

Figure 6:
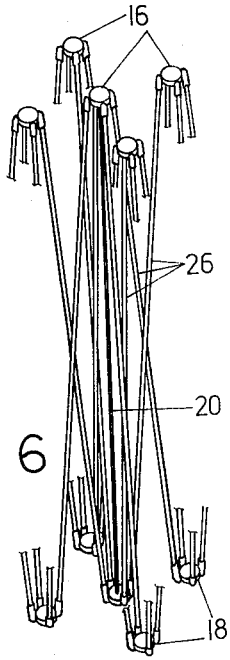
FIG. 6 is an isometric view of the structural components of the building construction system according to the present invention shown in their collapsed configuration with the membranes removed.

In order to collapse the building structure constructed in accordance with the present invention, it is only necessary to release the tension upon the tensile members 20. The respective ends of the compression struts 26 are received within the strut receiving cavities 38 in the strut connectors 36 and therefore are pivotable relative to the body member 32 of each of the node members inasmuch as the strut connectors 36 themselves are so pivotable. Thus, a releasing of the tensile members 20 allows each of the struts 26 to fold so as to be more nearly perpendicular to the body member 32 of each of the node members 16 and 18 to which it is attached. As is shown in FIG. 6, a releasing or relaxing of the tension members 20 allows the compression struts 26 to be folded to a generally vertical, and nearly parallel, configuration, so as to collapse the building structure by bringing the node members 16 and 18 close together. The building structure so collapsed may then be re-erected merely by again shortening or otherwise tensing the tensile members 20. The shortening and tensing of the tensile members 20 may be accomplished by drawing tight the tensile members extending through the holes 34 in the node members 16 and securing them to the clasps 22 on the exterior of the node members 16. This function is served in the building structure of FIG. 10 by the clasps, but it is understood that other suitable means for selectively securing the tensile members 20 may also be utilized within the spirit of the present invention. Thus, merely by releasing or tightening the tensile members 20, the building structure 10 may be either collapsed or erected.

The building structure 10 as illustrated in FIG. 1 differs slightly from the structural unit as illustrated in FIG. 2. As stated, at each of the node members 16 and 18 within the central part of the building structure 10, there are four compression struts 26 attaching thereto. Within the building structure 10 of FIG. 1, one oppositely oriented pair of each of the four compression struts 26 at each of the node members 16 and 18 does not extend directly radially outward from the respective node members 16 and 18, but instead crosses over the body member 32 of the respective node members 16 and 18 to proceed in the diametrically opposed direction. Thus, each of the node members 16 and 18 includes a pair of the compression struts 26 extending directly radially outward therefrom, and a second pair of compression struts 26 which crosses over the top or bottom of the node members 16 or 18 and then proceeds in the diametrically opposed direction from directly radially outward therefrom. By contrast, in the working unit of a building construction as illustrated in FIG. 2, each of the struts 26 extending from each of the node members 16 and 18 extends directly radially outward therefrom. In the embodiment shown in the building structure 10 of FIG. 1, this crossing of the one pair of the struts 26 at each of the node members 16 and 18 serves to resist twisting forces which otherwise tend to twist the node members 16 and 18.

Within the building structure 10, as can be seen in FIG. 1, each of the compression struts 26 is a part of a crossed pair at the node member at one of its ends, and is a part of an uncrossed pair extending radially outward from a node at the other of its ends. In this manner, all of the compression struts 26 may be of equal length while still retaining the advantages of the anti-twist feature of the building structure 10 as illustrated in FIG. 1. Resistance to twisting may also be obtained by selecting the pattern of sides on which the struts criss-cross to minimize the twist forces. The proper pattern will depend on the curvature of the structure.

Figure 7:
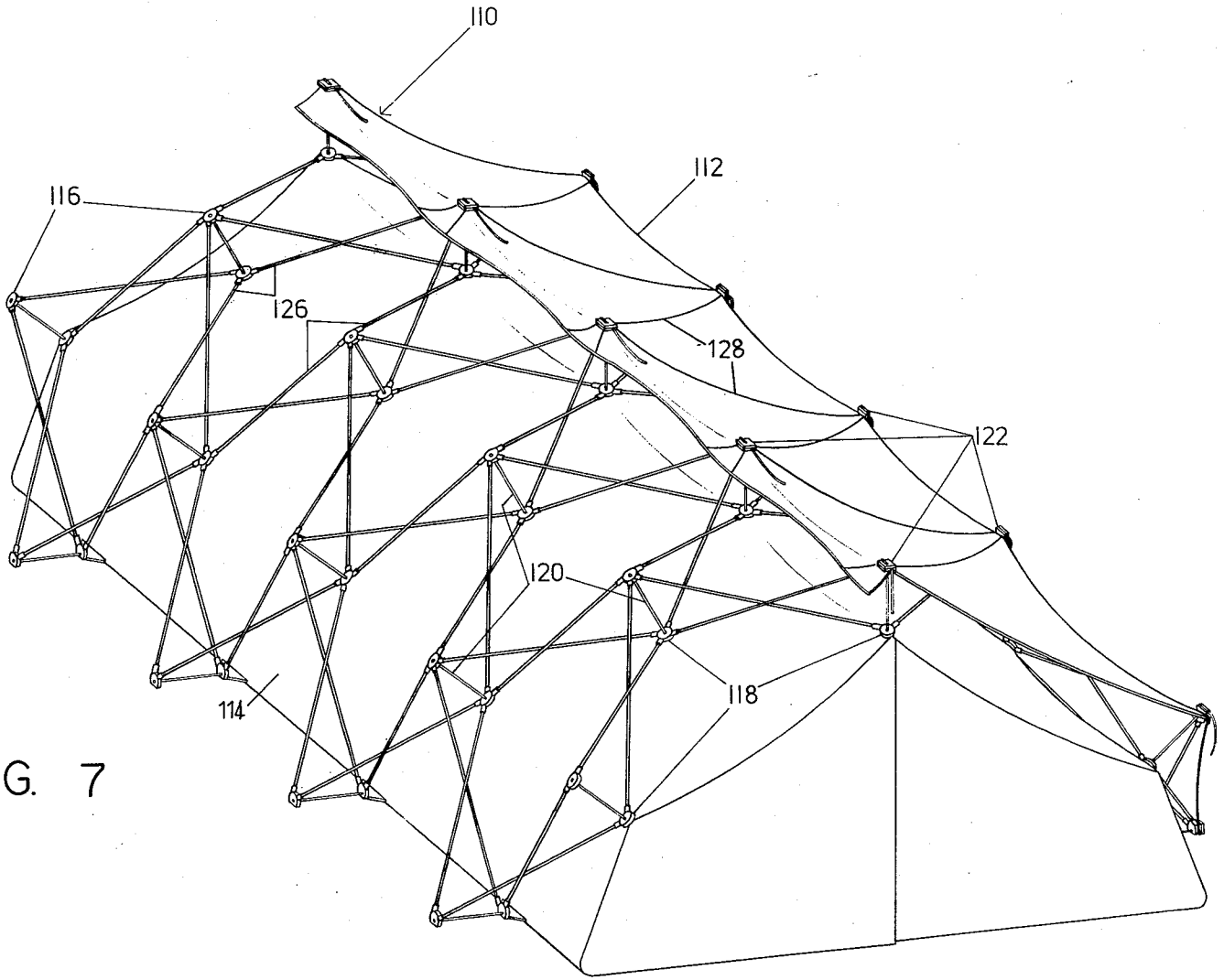
FIG. 7 is an isometric view, partially cut-away, showing barrel vault shaped embodiment of the invention, suitable for use as a tent.

Shown in FIG. 7 is a tent, generally indicated at 110, constructed in accordance with the building construction system of the present invention and illustrating a barrel vault shaped embodiment of the invention. The tent 110 includes an upper membrane 112 and a lower membrane 115, both formed of typical tent fabrics such as Nylon or Dacron. The structure 110 is particularly suited for use as a tent, since the upper membrane 112 acts as a water-repellant "fly", while the inner fabric can be formed to "breathe", as is typical in camping tent constructions. Attached to the upper membrane 112 are a plurality of node members 116, and attached to the lower membrane 114 are a plurality of node members 118. As in the building structure 10, the node members 116 and 118 are arranged at alternate intersection points of lines of tension in the membranes. Because of the curved nature of the tent 110, the distance between the node members 118 on the membrane 114 along the arch of the tent is of necessity slightly less than the distance between the node members 116 on the membrane 112. The node members 116 and 118 are paired in corresponding fashion, with a tensile member 120 extending between each corresponding pair of such node members. Clasps 122 are attached to each of the node members 116 so that the tensile members 120 may be secured thereto on the exterior of the membrane 112. Compression struts 126 extend from the node members 116 to the node members 118 to separate the membranes 112 and 114. Each of the compression struts 126 extends from one of the node members 116 to those node members 118 which are most closely adjacent to and equally distant from that node member 118 which is paired with the one node member 116. Whenever the building structure follows any form of a curve, continuous tucks 128 must be formed between node members to take up the slack of the membrane and keep it stressed taut across its surface. The section tucked in will have edges in the shape of a catenary curve and its mirror image. By forming such tucks, the entire membrane aids in carrying tension in the membrane.

The tent 110 functions in a similar manner as the building structure 10 in that it is a completely collapsible self-supporting structure. The various stresses experienced by the components by the tent 110 are similar to the stresses and forces experienced by the similar components in the building structure 10. The tent 110 is illustrated herein to indicate that the building construction system according to the present invention may be used to form surfaces and components having curved surfaces such as arches and domes, and even surfaces with multiple curves. The tent 110 also indicates that the building structural system of the present invention is adapted for use in a wide variety of constructions when it is required that the constructions be of a temporary character. Thus, in the tent of 110, all that is required to completely collapse the tent is to release each of the tensile members 120 to thereby completely collapse the structure and allow it to be stored in a compacted state. By contrast, to fully erect the tent 110 all that is required is for each of the tensile members 120 to be effectively shortened by drawing the tensile member 120 through the node member 116 securing the tensile member to the clasp 122 to thus form a completely erected and stable tent 110 which is capable of standing erected without the requirement of any additional poles, guys, or other similar supports normally required for tents. It is further envisioned that the building construction system of the present invention would be adaptable to a wide variety of shapes and sizes, and to a wide variety of curved and uncurved forms. Thus the building construction system may be used for a wide variety of uses on various size scales for both temporary and permanent uses. It is suitable for small scale structures (camping tents and sculptures), medium scale (residential and commercial) and large scale (arenas and airplane hangers).

Figure 8:
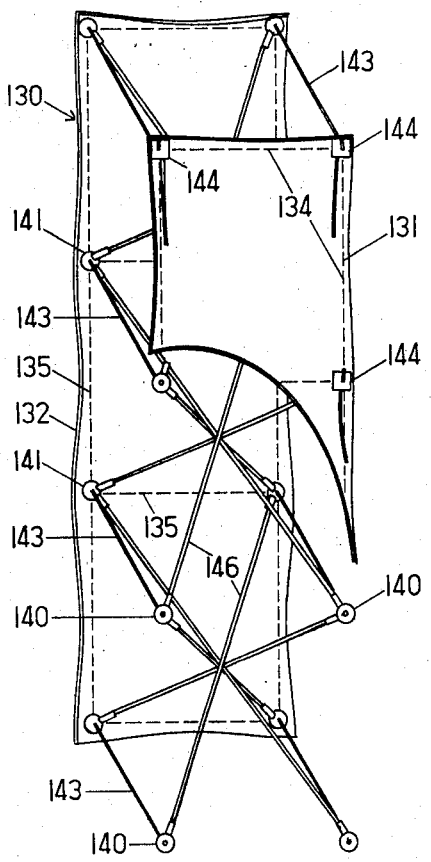
FIG. 8 is an isometric view, partially cut-away, showing a column shaped embodiment of the invention.

Another embodiment of the invention, which is suitable for formation of columnar building structures, is shown generally at 130 in FIG. 8. The structure includes first and second stretched membranes 131 and 132 respectively, which are disposed vertically in generally parallel spaced relation. Dashed lines labeled 134 are provided to illustrate the lines of tension formed in the first membrane 131. Similar dashed lines labeled 135 represent the lines of tension in the second membrane 132. The lines of tension in the two membranes define similar rectilinear grid patterns having a "ladder" shape, with the outer lines of tension lying substantially adjacent to the outer edges of the first and second membranes as shown.

A plurality of node members 140 are attached to the first membrane 131, and a corresponding plurality of node members 141 are attached to the second membrane 132. The node members on both membranes are attached to the membranes at each intersection of lines of tension in the membranes, with each node member on the first membrane being paired with a corresponding one of the node members on the second membrane.

A pliantly flexible tensile member 143 extends in tension from attachment to each node member on the first membrane to attachment to its paired node member on the second membrane. The flexible tensile members 143 are preferably securely attached to the node members 141, and extend through holes in the node members 140 to be releasably held by clasps 144 attached to the first membrane node members 140.

A plurality of compression struts 146 are provided to space the first and second membranes apart and to provide rigidity to the structure. The compression struts are arranged such that, at each node member 140 on the first membrane, struts extend from attachment to the node members 140 to attachment to each of the node members 141 on the second membrane which are most closely adjacent to the node member 141 on the second membrane which is paired with the one node member on the first membrane, and which do not lie along the same lines of tension in the second membrane as the paired node member. It will be seen, from an examination of the structure of FIG. 8, that the struts will thus lie substantially along the diagonals of the rectilinear lines of tension; i.e., compression struts will extend from a node member on the first membrane to those node members on the second membrane which are paired with those node members 140 on the first membrane which are diagonally across from the node member 140 from which the compression struts extend. The node members 140 and 141 are formed substantially as described above for the node members 16, and the compression struts 146, the clasps 144, and the membranes 131 and 132, are composed of the same materials and perform similar functions as described above for the building structures 10 and 110.

The columnar structure 130 illustrated in FIG. 8 may be considered to be a special case of the structure 10 shown in FIG. 1. The columnar structure basically consists of the placement of node members at each intersection of the lines of tension in the rectilinear grid rather than at alternate intersections of lines of tension as shown in FIG. 1. The result is a structure which has substantially greater edge rigidity in column form. This greater edge rigidity is not necessary in larger expanded structures such as shown in FIG. 1.

Figure 9:
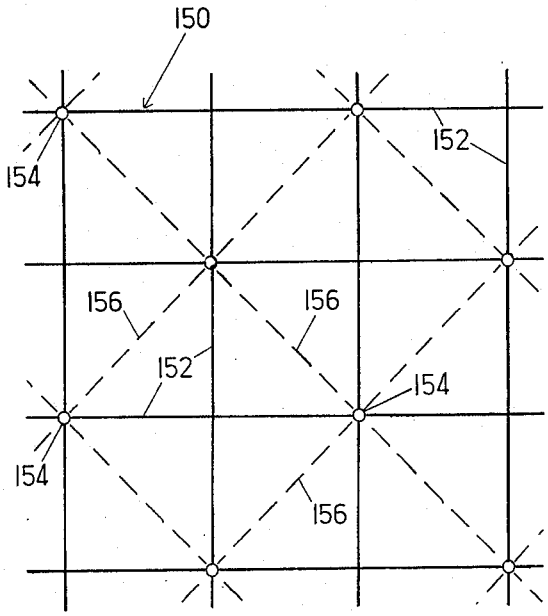
FIG. 9 is a somewhat simplified plan view of a flat structure in accordance with the invention in which node members are connected by rectilinear grids of tension members.

A somewhat simplified schematic plan view of another embodiment of the building structure is shown generally at 150 in FIG. 9. The structure 150 is formed by replacing the stretched membranes, such as the membranes 12 and 14 of FIG. 1, with a rectilinear grid of flexible tension members 152. Node members 154 are attached to the tension members 152 at alternate intersection points of the tension members. Thus, the node numbers 154 are arranged such that each node member is separated by crossed over tension members from adjacent node members which lie along the same tension members.

For purposes of illustration, the positions of crossed over compression struts in the structure 150 are illustrated by the dash lines labeled 156. It should be understood that there are two rectilinear grids of flexible tension members, a first rectilinear grid corresponding to the first stretched membrane 12 of FIG. 1, and a second rectilinear grid corresponding to the second stretched membrane 14 of FIG. 1. Thus, each of the node members 154 on the first rectilinear grid is paired with an underlying node member (not shown) on the second rectilinear grid. Compression struts extend along the dash lines 156 and are formed in a manner entirely identical to and performing the same functions as the compression struts 26 shown in FIG. 1. In addition, tensile members (not shown in FIG. 9) also extend in tension from attachment to node members on the lower rectilinear grid up to attachment to the node members 154 on the first rectilinear grid. All other details of construction of the structure 150 are identical to the details described for the structure 10 of FIG. 1. In this regard, it may be considered that the structure 150 is formed identically to the structure of FIG. 1 with the exception that the membranes 12 and 14 are replaced by flexible tension members which extend between the node members along the lines of tension 17 and 19 respectively.

It is understood that the invention is not confined to the particular construction and arrangement of parts herein illustrated and described, but embraces all such modified forms thereof as come within the scope of the following claims.

I claim:

1. A structure comprising:

(a) first and second membranes disposed in spaced relation and having lines of tension defining corresponding rectilinear grid patterns in each of said membranes;

(b) a plurality of node members attached to each of the two membranes such that each node member on said first membrane is paired with a corresponding one of said node members on said second membrane, said node members on each of said membranes being arranged along each line of tension such that each node member is located at an intersection of lines of tension in said membranes and is separated by intersecting lines of tension in said membranes from adjacent node members lying along the same lines of tension;

(c) a plurality of tensile members, each said tensile members extending in tension from attachment to one of said node members on said first membrane to attachment to the node member on said second membrane that is paired with said one node member on said first membrane; and (d) a plurality of compression struts, said struts being arranged such that, at each node member on said first membrane, struts extend in compression from attachment to said node member on said first membrane to attachment to each of said node members on said second membrane which are most closely adjacent to and substantially equidistant from the node member on said second membrane which is paired with said one node member on said first membrane, whereby said struts will lie substantially along the diagonals of the rectilinear lines of tension which extend between adjacent node members.

2. The structure of claim 1 wherein each of said node members in the interior of the structure includes four strut connectors which are adapted to receive the ends of the appropriate compression struts therein, said strut connectors being secured to said node members so as to be pivotable relative thereto.

3. The structure of claim 2 wherein each of said compression struts extending from each of said node members extends directly radially outward therefrom.

4. The structure of claim 2 wherein two of the four compression struts attached to each of said node members in the interior of the structure crosses over the respective node member to which it is attached while the two other of said compression struts attached to each of said node members extends directly radially outward therefrom.

5. The structure of claim 2 wherein each of said strut connectors includes a strut receiving hole therein to receive and hold one end of a compression strut therein.

6. The structure of claim 1 wherein the distances between node members on said second membrane are selected to be less than the distances between node members on said first membrane such that said membranes describe a curved configuration.

7. The structure of claim 6 wherein the curved configuration is a barrel vault and said first and second membranes are composed of a fabric with said node members being firmly attached to the fabric, whereby the structure can be used as a tent.

8. The structure of claim 1 wherein the length of the tension members in said second rectilinear grid between the node members thereon are selected to be less than the length of tension members on said first grid between the node members thereof such that the erected collapsible structure describes a curved configuration.

9. A columnar structure comprising:

(a) first and second membranes disposed in spaced relation and having lines of tension defining a rectilinear ladder grid pattern in said membrane with the outer lines of tension lying adjacent to the outer edges of said first and second membranes;

(b) a plurality of node members attached to each of the two membranes at the intersections of the lines of tension in said membranes, each said node member on said first membrane being paired with a corresponding one of the node members on said second membrane;

(c) A plurality of tensile members, each of said tensile members extending in tension from attachment to one of said node members on said first membrane to attachment to the node member on said second membrane that is paired with said one node member on said first membrane; and (d) a plurality of compression struts, said struts being arranged such that, at each node member on said first membrane, struts extend in compression from attachment to said node member on said first membrane to attachment to each of said node members on said second membrane which are most closely adjacent to the said node member on said second membrane paired with said node member on said first membrane and not lying along the same lines of tension in said second membrane as said paired node member, whereby said struts will lie substantially along the diagonals of the rectilinear lines of tension.

10. The structure of claim 1 or 9 wherein said tensile members extend through their respective node members on said first membrane, and further including means for selectively securing said tensile members to said node members to hold said tensile members in tension.

11. The structure of claim 10 wherein said tensile members are pliantly flexible and wherein said means for securing said tensile members comprises a clasp formed of two flat members resiliently held together which are mounted to one each of said node members and adapted to engage and releasably hold said flexible tensile members.

12. A structure comprising:

(a) a plurality of flexible tension members arranged to form a first rectilinear grid pattern;

(b) a second plurality of flexible tension members arranged to form a second rectilinear grid pattern substantially corresponding to that of said first rectilinear grid pattern of flexible tension members and disposed in spaced relation thereto;

(c) a plurality of node members attached to each of the two rectilinear grids of tension members such that each node member on the first rectilinear grid is paired with a corresponding one of the node members on the second rectilinear grid, said node members being attached to said tension members at intersection points of the tension members, said node members on each of said rectilinear grids being arranged along each of said tension members such that each node member is separated by crossed-over tension members from adjacent node members lying along the same tension members;

(d) a plurality of tensile members, each of said tensile members extending in tension from attachment to one of said node members on said first rectilinear grid to attachment to the node member on said second rectilinear grid which is paired with said one node member on said first rectilinear grid; and (e) a plurality of compression struts, said struts being arranged such that, at each node member on said first rectilinear grid, struts extend in compression from attachment to said node member on said first rectilinear grid to attachment to each of said node members on said second rectilinear grid which are most closely adjacent to and substantially equidistant from the node member on said second rectilinear grid which is paired with said one node member on said first rectilinear grid, whereby said struts will lie substantially along the diagonals of the rectilinear grids which extend between adjacent node members.

13. The structure of claim 12 wherein said tensile members extend through their respective node members on said first rectilinear grid and including means for selectively securing said tensile members to said node members to hold said tensile members in tension.

14. The structure of claim 12 wherein said tensile members are pliantly flexible and wherein said means for securing comprises a clasp formed of two flat members resiliently held together mounted to each of said node members on said first rectilinear grid and adapted to engage and releasably hold said flexible tensile members.

15. The structure of claim 12 wherein each of said node members in the interior of the structure includes four strut connectors which are adapted to receive and hold the ends of the appropriate compression struts therein, said strut connectors being secured to said node members so as to be pivotable relative thereto.

16. The structure of claim 15 wherein each of said compression struts extending from each of said node members extends directly radially outward therefrom.

17. The structure of claim 15 wherein two of the four compression struts attached to each of said node members in the interior of the structure crosses over the respective node member to which it is attached while the other two of said compression struts attached to each of said node members extends directly radially outward therefrom.

18. The structure of claim 15 wherein each of said strut connectors includes a strut receiving hole therein to receive and hold one end of a compression strut therein.

* * * * *